US009752386B2

(12) United States Patent
Downton

(10) Patent No.: US 9,752,386 B2
(45) **Date of Patent: *Sep. 5, 2017**

(54) STEERABLE DRILLING SYSTEM

(71) Applicant: Schlumberger Technology Corporation, Sugar land, TX (US)

(72) Inventor: Geoffrey C. Downton, Stroud (GB)

(73) Assignee: SCHLUMBERGER TECHNOLOGY CORPORATION, Sugarland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/495,860

(22) Filed: Sep. 24, 2014

(65) Prior Publication Data

US 2015/0008045 A1 Jan. 8, 2015

Related U.S. Application Data

(63) Continuation of application No. 13/205,038, filed on Aug. 8, 2011, which is a continuation of application No. 13/096,250, filed on Apr. 28, 2011, now Pat. No. 8,893,824, which is a continuation of application No. 10/995,757, filed on Nov. 23, 2004, now Pat. No. 8,011,452.

(30) Foreign Application Priority Data

Nov. 26, 2003 (GB) ..... 0327434.7

(51) Int. Cl.
*E21B 7/08* (2006.01)
*E21B 7/06* (2006.01)
*E21B 17/10* (2006.01)

(52) U.S. Cl.
CPC ..... *E21B 7/068* (2013.01); *E21B 7/062* (2013.01); *E21B 17/1014* (2013.01)

(58) Field of Classification Search
CPC ... E21B 4/02; E21B 7/06; E21B 7/062; E21B 7/068
See application file for complete search history.

(56) References Cited

U.S. PATENT DOCUMENTS

| | | | | |
|---|---|---|---|---|
| 4,686,658 | A * | 8/1987 | Davison | E21B 47/185 137/487.5 |
| 5,168,941 | A * | 12/1992 | Krueger et al. | 175/26 |
| 6,213,226 | B1 * | 4/2001 | Eppink et al. | 175/61 |
| 6,581,690 | B2 * | 6/2003 | Van Drentham-Susman | E21B 29/06 166/298 |
| 8,011,452 | B2 | 9/2011 | Downton | |
| 2003/0121702 | A1 * | 7/2003 | Downton | E21B 7/068 175/76 |

(Continued)

FOREIGN PATENT DOCUMENTS

WO WO 0134935 A1 * 5/2001

OTHER PUBLICATIONS

Search Report for corresponding GB Application Serial No. 0327434.7, dated May 13, 2004, 6 pages.

(Continued)

*Primary Examiner* — Robert E Fuller

(57) ABSTRACT

A steerable system comprises a fluid powered motor 10 having a rotor 16 and a stator 18, and a bias arrangement having a plurality of bias pads 34 connected to the stator 18 so as to be rotatable therewith, the bias pads 34 being moveable to allow the application of a side load to the steerable system.

22 Claims, 3 Drawing Sheets

(56) References Cited

U.S. PATENT DOCUMENTS

| | | | |
|---|---|---|---|
| 2011/0266063 | A1 | 11/2011 | Downton |
| 2012/0012396 | A1 | 1/2012 | Downton |

OTHER PUBLICATIONS

Examination Report for corresponding GB Application Serial No. 0327434.7, dated Apr. 4, 2006, 5 pages.
Search Report for corresponding GB Application Serial No. 0327434.7, dated May 17, 2006, 3 pages.
Examination Report for corresponding GB Application Serial 0327434.7, dated Dec. 7, 2006, 5 pages.
Examination Report for corresponding GB Application Serial No. 0327434.7, dated May 14, 2007, 3 pages.
Examination Report for corresponding GB Application Serial No. 0327434.7, dated Jun. 22, 2007, 3 pages.
Combined Search and Examination Report for corresponding GB Application Serial No. 0716362.9, dated Oct. 26, 2007, 4 pages.
Examination Report for corresponding GB Application Serial No. 0716362.9, dated Apr. 23, 2008, 3 pages.
Notification of Grant for corresponding GB Application Serial No. 0327434.7, dated Sep. 18, 2007, 2 pages.
Notification of Grant for corresponding GB Application Serial No. 0716362.9, dated May 20, 2008, 2 pages.
Decision on Appeal for corresponding U.S. Appl. No. 13/205,038, dated Jun. 27, 2016, 9 pages.

* cited by examiner

STEERABLE DRILLING SYSTEM

CROSS REFERENCE TO RELATED APPLICATIONS

This application claims priority to U.S. patent application Ser. No. 13/205,038 filed Aug. 8, 2011, U.S. patent application Ser. No. 13/096,250 filed Apr. 28, 2011 and U.S. patent application Ser. No. 10/995,757 filed Nov. 23, 2004, which claims priority to UK Patent Application Number 0327434.7 filed 26$^{th}$ Nov. 2003, all incorporated herein by reference.

BACKGROUND OF THE INVENTION

This invention relates to a steerable drilling system and components thereof for use in the formation of, for example, a wellbore for use in the extraction of hydrocarbons.

A known steerable drilling system comprises a downhole motor used to drive a drill bit for rotation about an axis thereof. A bias unit is located between the motor and the drill bit and arranged to apply a biasing, sideways acting load to the drill bit to urge the drill bit form a curve in the borehole being drilled. The bias unit typically comprises a housing upon which a number of movable, for example pivotable, flaps or pads are mounted, and actuators in the form of pistons associated with the pads to drive the pads between retracted and extended positions. A control unit is provided to control the operation of the actuators. The control unit may include a valve arrangement for controlling the application of pressurised fluid to the pistons, and hence to control the position adopted by the pads at any given time. By appropriate control, the pads can be urged against one side of the wall of the bore being formed to apply a side load to the bias unit and any component secured thereto, for example the drill bit, thereby allowing the drill bit to be steered.

In use, when a curve, or dogleg, is to be formed in the wellbore, the control unit causes the actuators to move the pads between their retracted and extended positions as the bias unit rotates so that the pads apply a lateral or sideways acting biasing load to the bias unit and drill bit, the biasing load acting in a substantially constant direction causing the bit to form the desired dogleg in the wellbore.

As the bias unit operates by applying relatively high pressure fluid to one end of each piston, the other end having lower pressure fluid applied thereto, a significant fluid pressure drop must be present in the downhole environment in order for the fluid to operate. Typically, the bias unit requires a pressure drop of around 700 psi to function correctly. In some applications, the pressure at which drilling fluid can be supplied is restricted and, where other downhole components also require a pressure drop to operate correctly or efficiently, it may be undesirable or impractical to use a bias unit of this type.

Drilling fluid or mud powered motors, for example in the form of progressive cavity motors known as Moineau motors, are becoming increasingly commonly used in this type of application. However, the use of such motors in conjunction with bias units of the type mentioned hereinbefore is problematic as the control unit for the bias unit is located between the motor and the bias unit resulting in these components being spaced apart from one another by a significant distance. This can limit achievable build and turn rates. Further, where the control unit controls the supply of fluid under pressure to the actuators, the fluid must be supplied through or past the motor.

SUMMARY

According to the present invention there is provided a steerable system comprising a fluid powered motor having a rotor and a stator, and a bias arrangement having a plurality of bias pads connected to the stator so as to be rotatable therewith, the bias pads being moveable to allow the application of a side load to the steerable system.

Conveniently, each bias pad is moveable by an actuator. Each actuator may comprise a piston to which fluid can be supplied to move the associated bias pad from its retracted position towards its extended position. A control arrangement may be used to control the operation of the actuators, the control arrangement preferably comprising a valve. Although arrangements may be possible which make use of a rotary valve controlling the flow of fluid from an inlet port to a plurality of outlet ports, each outlet port being associated with a respective actuator, the control arrangement preferably comprises a plurality of bistable actuators and associated valves, each bistable actuator and associated valve being associated with a respective one of the actuators for the pads. The bistable actuators are conveniently solenoid or electromagnetically operated. It will be appreciated, however that the bistable actuators could take a wide variety of forms and the term is intended to cover any actuator having two stable conditions, little or no power being used to hold the actuator in its stable conditions. Conveniently, the bistable actuators are switchable between their stable conditions using little power.

In such an arrangement, a sensor and control unit may be located at a position remote from the bias arrangement, the sensor and control unit being arranged to supply control signals to the bistable actuators to move the pads to their desired positions. The sensor and control unit may be connected to the bistable actuators using suitable control lines, for example in the form of electrical cables.

The pads of the bias arrangement may be mounted directly upon the stator. Alternatively, they may be mounted upon a separate housing rotatable with the stator. For example, the separate housing may be connected to the stator by a flexible drive connection to transmit rotary motion of the stator to the separate housing, but to allow the separate housing to be angularly displaced relative to the axis of the stator.

The invention also relates to a steerable system comprising a downhole motor, a bias arrangement including plurality of bias pads, and a control arrangement for use in controlling the movement of the bias pads between extended and retracted positions, the control arrangement including a plurality of bistable actuators, each of which is associated with a respective one of the bias pads.

According to another aspect of the invention there is provided a steerable system comprising a fluid powered motor, a drill bit arranged to be driven by the motor, a bias arrangement and a control unit arranged to control the operation of the bias arrangement, wherein the motor is located between the drill bit and the least part of the control unit.

According to another aspect of the invention there is provided a steerable drilling system comprising a fluid driven downhole motor having an upstream region and a downstream region, a fluid pressure drop occurring in use, between the upstream and downstream regions, and a bias unit having an actuator piston, one end surface of which is exposed to the fluid pressure within a chamber which is communicable through a valve arrangement with the upstream region.

The bias unit and motor are conveniently integral with one another, passages preferably being provided in the motor to allow the supply of fluid from the upstream region to the said chamber.

Such an arrangement is advantageous in that the bias unit operates by making use of the fluid pressure drop caused by the provision of the downhole motor. As a result, the system may be used to achieve steerable drilling in applications in which drilling fluid pressure is restricted.

The valve arrangement is preferably located at the upstream region, along with a control unit for controlling the operation thereof. This has the advantage that, in the event of a lost hole-type event, it may be possible to recover the control unit.

The downhole motor is preferably a progressive cavity motor, for example a Moineau motor.

BRIEF DESCRIPTION OF THE DRAWINGS

The invention will be further described, by way of example only, with reference to the accompanying drawings, in which.

DETAILED DESCRIPTION OF THE PREFERRED EMBODIMENTS

Figure 1:
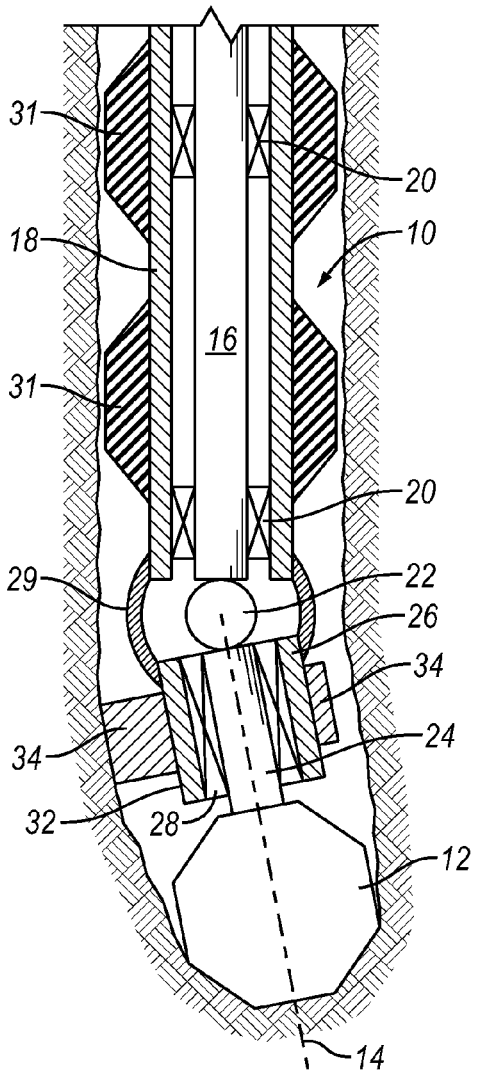
FIG. 1 is a diagrammatic view illustrating a steerable system in accordance with another embodiment of the invention.

Referring firstly to FIG. 1, a steerable system for use in the formation of a wellbore is shown. The steerable system comprises a downhole motor 10 arranged to drive a drill bit 12 for rotation about an axis 14 thereof. The motor 10 is a fluid driven motor and comprises a rotor 16 rotatable within a generally cylindrical stator 18. The rotor 16 is supported for rotation within the stator 18 by bearings 20. The outer surface of the rotor 16 and the inner surface of the stator 18 are provided with formations which cooperate with one another to define a series of cavities which are isolated from one another and which progress along the length of the motor 10 as the rotor 16 rotates relative to the stator 18. A progressive cavity motor of this type is sometimes referred to as a Moineau motor.

The stator 18 of the motor 10 is connected to the drill string by which the steerable system is carried so as to be rotatable therewith. The rotor 16 is connected through a universal joint 22 to the drive shaft 24 of the drill bit 12.

The drive shaft 24 extends through a cylindrical housing 26, bearings 28 being provided to support the drive shaft 24 for rotation within the housing 26. the housing 26 is connected to the stator 18 through a flexible drive arrangement 29 which allows the axis of the housing 26 and drive shaft 24 to be angularly displaced relative to the axis of the rotor 16, but does not allow relative rotary movement between the stator 18 and the housing 26 to take place, or at least restricts such movement to a very low level.

The outer surface of the stator 18 is provided with upper and lower stabilisers 31 which engage the formation being drilled to restrict or resist lateral movement of the motor 10 within the wellbore, holding the motor 10 generally concentrically within the borehole. Although described as upper and lower stabilisers it will be appreciated that the wellbore being drilled may extend generally horizontally, in which case the stabilisers may actually lie side-by-side rather than one above the other, and the description should be interpreted accordingly.

The housing 26 is provided on its outer surface 32 with a plurality of bias pads 34. The bias pads 34 are each pivotally mounted to the housing 26 so as to be moveable between a retracted position and an extended position. In FIG. 1, the left hand bias pad 34 is shown in its extended position and the right hand pad 34 is shown in its retracted position. Actuators (not shown) in the form of pistons are provided to drive the bias pads 34 between their retracted and extended positions, the actuators being connected to the valve arrangement operable under the control of a control unit (not shown) to control the supply of fluid to the actuators and hence to control movement of the pads 34. The valve arrangement is conveniently electrically, for example solenoid, or electromagnetically operated, controlling the supply of fluid ported from the motor to the actuators. Such an arrangement allows the control unit to be located remotely, for example above the motor. However, it will be appreciated that other arrangements are possible.

In use, the motor 10 is held by the drill string against rotation or is arranged to rotate at a low rotary speed. Fluid is supplied under pressure to the drill string, typically by a surface mounted pump arrangement. The fluid is forced through the motor 10 causing the rotor 16 to rotate relative to the stator 18. The rotary motion of the rotor 16 is transmitted through the universal joint 22 to the drive shaft 24, thereby driving the drill bit 12 for rotation. The motion of the drill bit 12, in conjunction with the weight applied to the bit 12, in use, causes the bit 12 to scrape or abrade material from the formation which is subsequently washed away by the fluid supplied to the wellbore.

When it is determined that a dogleg should be formed in the wellbore, the control unit is operated to cause the bias pad 34 on one side of the housing 24 to be moved to its extended position and into engagement with the surrounding formation, thereby applying a sideways or laterally acting load to the housing 24 and the drill bit 12, urging the drill bit 12 to scrape or abrade material from a part of the wellbore spaced from the axis thereof. The application of the load does not alter the position of the motor 10.

After the desired dogleg has been formed, the extended pad 34 is allowed to return to its retracted position.

Usually, the stator 18 of the motor 10 is not held completely stationary in use but rather is driven at a low speed by the drill string. In these circumstances, it will be appreciated that during the formation of the dogleg in the wellbore the housing 24 will also rotate at a low speed and the pads 34 need to be moved between their retracted and extended positions in turn as the housing 24 rotates in order to form the dogleg in the borehole in the desired direction.

Figure 2:
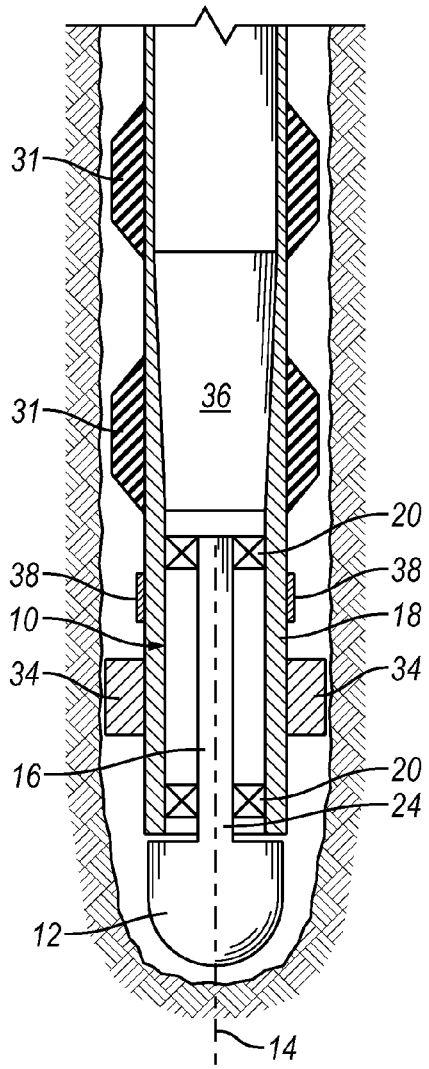
FIG. 2 is a view similar to FIG. 1 illustrating an alternative embodiment.

FIG. 2 illustrates a steerable system which, in some respects is similar to that shown in FIG. 1, and like reference numerals will be used herein to denote like or similar parts In the arrangement of FIG. 2, the rotor 16 and the drive shaft 26 for the drill bit 12 are not connected to one another through a universal joint, but rather are rigidly connected to one another, or integral with one another. The bias pads 34 are not pivotally mounted to a housing 24, but rather are mounted upon the stator 18. Operation of this arrangement is similar to that described with reference to FIG. 1, but as the bias pads are carried by the stator 18, the motor 10 is tilted relative to the borehole by the bias pads 34 during the formation of a curve.

The actuators used to drive the pads 34 between their retracted and extended positions take the form of pistons to which fluid is supplied under pressure, at the appropriate time, through a valve arrangement controlled by the control unit. The valve arrangement could take the form of a rotary valve controlling the supply of fluid from an inlet to a plurality of outlets, in turn, each of the outlets communicating with a respective one of the pistons. However, this need not be the case and FIG. 2 illustrates an arrangement in which the control unit 36 controls the operation of a plurality of bistable, solenoi operated actuators 38, each of which is associated with the actuator of a respective one of the pads 34 to control movement of the pads 34 between their retracted and extended positions. As the bistable actuators 38 are electrically controlled, the provision of additional fluid flow channels through the motor 10 between the control unit 36 and the pads 34, and the use of complex valve arrangements can be avoided, instead suitable electrical cables extending between the bistable actuators 38 and the control unit 36. As mentioned hereinbefore, the bistable actuators could take a range of alternative forms.

A similar control arrangement could be used in the steerable system of FIG. 1, if desired.

It will be appreciated that the steerable systems described hereinbefore have a number of advantages over the prior art arrangements. One significant advantage is that the bias pads can be located relatively close to the stabilisers associated with the fluid driven motor, thereby allowing the formation of a wellbore with relatively sharp changes of direction. Further, as mentioned hereinbefore, the provision of complex valves and porting arrangements can be avoided. Another advantage is that as the control unit can be located above the motor, in the orientation illustrated, the sensor package provided in the control unit can be used to undertake measurements whilst drilling is occurring. Yet another advantage is that, as the bias pads 34 are located in positions in which they rotate only slowly, if at all, in use, the bias pads 34 and associated drive arrangements will not be subject to high levels of wear which occur in some prior arrangements.

Figure 3:
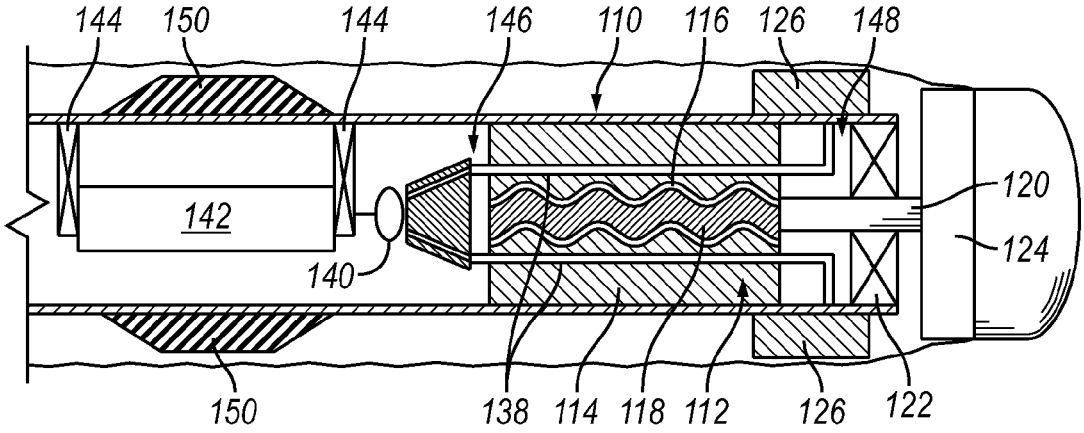
FIG. 3 is a diagrammatic view of a steerable drilling system in accordance with another embodiment of the invention.
Figure 4:
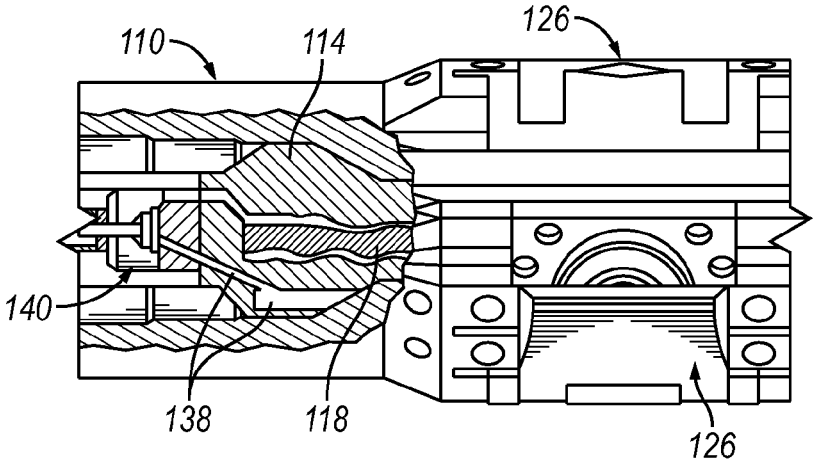
FIG. 4 is a diagrammatic view, partly in section, illustrating part of the system of FIG. 3.
Figure 5:
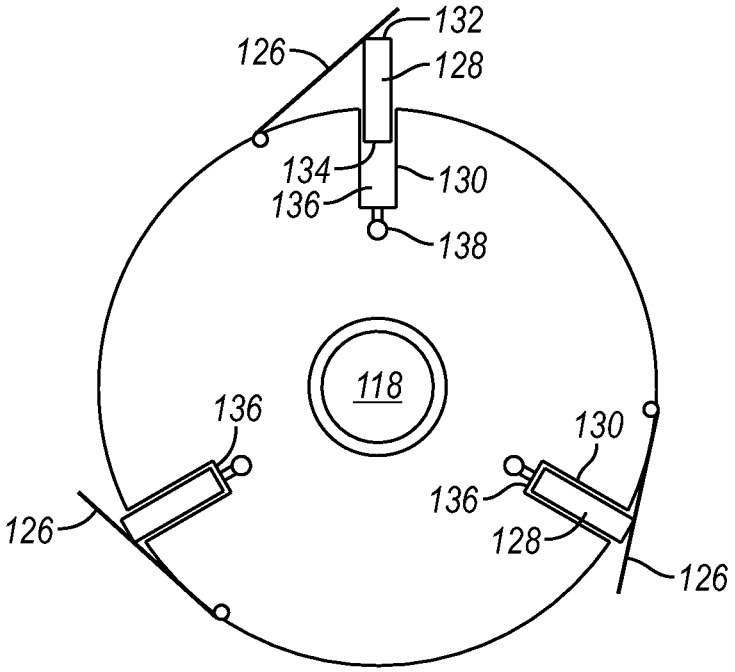
FIG. 5 is a diagrammatic view illustrating the operation of the system.

Referring next to FIGS. 3 to 5 there is shown part of a steerable drilling system which comprises a housing 110 containing a drilling fluid driven downhole motor 112. the motor 112 is, again, of the progressive cavity type, the motor comprising a stator 114 mounted to the housing 110 and defining a longitudinally extending passage 116 of generally helical form. Within the passage 116 is located a rotor 118, the outer surface of which is also shaped to define a helix which cooperates with the surface defining the passage 116 to form a series of chambers which are isolated from one another, the chambers progressing from one end of the motor 112 to the other end thereof as the rotor 118 rotates relative to the stator 114.

In use, fluid is supplied under pressure to the interior of the housing 110 from a suitable surface mounted pump arrangement, the fluid being supplied to the cavities between the rotor 118 and stator 114 and causing the rotor 118 to rotate relative to the stator 114, thereby allowing the fluid to flow from an upstream end or region of the motor 112 to a downstream end or region thereof.

A drive shaft 120 is secured to the rotor 118 and arranged to rotate with the rotor 118, and the drive shaft 20 being supported by bearings 122 and being arranged to carry a suitable downhole drill bit 124. Although not illustrated in the accompanying drawings, a flexible coupling is likely to be required between the driveshaft 120 and the rotor 118 in order to accommodate the eccentric motion of the rotor 118, which occurs in use.

The housing 110 supports, in this embodiment, in three angularly spaced bias pads 126 (only two of which are shown in FIGS. 3 and 4 of the drawings), but it will be appreciated that more or fewer pads may be provided. The pads 126 are each pivotally connected to the housing 110 and are moveable between retracted and extended positions. In the orientation illustrated in FIG. 3, the uppermost one of the pads 126 occupies its extended position, the lower pad 126 being located in its retracted position. Actuators in the form of pistons (see FIG. 5) are provided to move the pads 126 between their extended and retracted positions. Each actuator comprises a piston 128 slidable within an associated cylinder 130. At first end 132 of each piston 128 cooperates with the associated pad 126 while a second end 134 of each piston 128 defines, with the associated cylinder 130, a chamber 136. The chambers 136 communicate through respective passages 138 formed in the stator 114 with a valve arrangement 140 located at the upstream end of the motor 112. The valve arrangement 140 is a rotary valve arrangement designed to allow fluid under pressure to be supplied through one if the passages 138 to the chamber 136 associated with one of the pistons 128, the selection of which of the passages 138 is to be supplied with drilling fluid under pressure being determined by the angular position of the rotary valve 140. The angular position adopted by the rotary valve 140 is controlled by a suitable control device 142 supported through appropriate bearings 144 within the housing 110.

As briefly described hereinbefore, in use, the housing 110 is supplied with drilling fluid under pressure. The fluid is supplied to an upstream end or region 146 of the motor 112, the fluid passing through the motor 112 to a downstream region 148, the movement of the fluid through the motor 112 causing the drive shaft 120 to rotate relative to the housing 110, and thus causing the drill bit 124 to rotate about its axis. In addition, drilling fluid is supplied under pressure from the upstream region 146 to one of the passages 138 causing the associated one of the pads 126 to be forced into its extended position, the other two pads 126 occupying their retracted positions. The selection of which of the pads 126 occupies its extended position is determined by the control unit 142 which controls the operation of the rotary valve 140. Typically the control unit 42 will be adapted to remain non-rotating, in space, and thus hold the rotary valve 140 also non-rotating in space. Any rotation of the housing 110 around the rotary valve 140 will cause a change in which of the passages 138 is supplied with fluid under pressure, and thus cause a change in which of the pads 126 occupies its extended position, the result of which is that, whilst the control unit 142 remaining non-rotating in space, the extended pad 126 will always be on the same side of the borehole being formed by the steerable drilling system. In such an arrangement, the pads 126 apply to a side load to the housing 110 and to the drill bit 124 urging the drill bit 124 to form a borehole of a curved form, the borehole being curved away from the extended pad 126 at any given time.

As the second ends of the pistons used to drive the pads 126 receive fluid under pressure from the upstream region 146 of the motor 112, and the first ends of the pistons are exposed to the fluid pressure in the annulas between the housing 110 and the wall of the borehole being formed, which is substantially equal to the pressure at the downstream end of the motor, the actuators make use of the pressure drop across the motor 112 rather than requiring the provision of an additional pressure drop within the downhole system, thereby reducing the degree of pressurisation of the drill fluid which must be achieved at the surface for the drilling system to operate correctly.

As shown in FIG. 3, the housing 110 is conveniently provided with upper stabiliser pads 50 which serve to define the point at which the housing 110 will pivot upon the application of a side load thereto by the pads 126.

The steerable drilling system described hereinbefore has a number of advantages over a conventional arrangement. In addition to being capable of being operated with reduced drilling fluid pressure, the location of the control unit 142 on the upstream end of the motor 112 results in an increased likelihood of the control unit 142 and/or the valve 140 being recoverable in the event of the majority of the downhole unit becoming lost, in use. As these components of the system are relatively complex, and hence expensive, retrieval of these components is desirable. Another advantage is that, as the housing 110 is rotated relatively slowly, in use, the bias pads 126 will wear at a reduced rate compared to conventional arrangements. Further, constraints are placed upon the rotary speed of the drill bit by the presence of the bias unit pads in a conventional arrangement are largely removed.

The arrangement hereinbefore described may be modified in a number of ways within the scope of the invention. For example, the position of the stabiliser pads 150 and the bias pads 126 may be reversed in order to achieve a point-the-bit type steering system rather than the push-bit type system illustrated. Another modification is that where the stator 114 is flexible, the passages 138 extending through the stator 114 may be arranged to inflate the end of the stator adjacent the downstream region 148 to form a relatively close fir between the rotor and the stator and thereby reduce leakage.

Further, the control unit need not be of the roll-stabilised form described hereinbefore but could, alternatively comprise, for example, a strap-down type system. Where used with a strap-down type control unit, then a single axis accelerometer could be built into the downstream end of the housing 110 and connected by a wire extending through the motor 112 to the strap-down control unit to provide an input to the control unit. Further, the control unit could be powered using an alternator connected to the drive shaft 120, a suitable cable extending through the motor 112 to transmit the electrical power from the alternator to the control unit, providing a relatively simple way of supplying power to the control unit. Another possible modification is to use switchable valves to control the supply of fluid to the actuators associated with the pads. The switchable valves are conveniently controlled by the control unit so as to ensure that the pads are moved between their extended and retracted positions at the desired times. The switchable valves could take a range of forms. For example, the switchable valves could comprise solenoid actuated valves.

Although specific embodiments have been described hereinbefore with reference to the accompanying drawings, it will be appreciated that a number of modifications and alterations may be made thereto within the scope of the invention as defined by the appended claims.

What is claimed is:

1. A steerable drilling system, comprising:

a fluid powered motor having a rotor and a stator within a housing, the stator being coupled into a drillstring so as to be rotatable therewith, and a bias arrangement having at least three angularly spaced bias pads connected to the stator so as to be rotatable therewith, the bias pads being selectively moveable, while the drillstring is rotating, by a pressure differential between a higher pressure of drilling fluid upstream of the fluid powered motor and a lower pressure of drilling fluid in a wellbore annulus outside of the fluid powered motor, the bias pads being selectively exposed to the higher pressure via passages within an interior of the housing, the passages being located through at least a portion of the stator and extending from upstream of the rotor and past the rotor to a downstream side of the rotor, the bias pads being selectively movable to radially extended positions, while the stator is rotated in a borehole, to steer the steerable drilling system so as to form the borehole with a desired curved form via application of side loads to the steerable drilling system.

2. The system as recited in claim 1, wherein each bias pad is moveable by an actuator.

3. The system as recited in claim 2, wherein each actuator comprises a piston to which the drilling fluid can be supplied to move the associated bias pad from a retracted position towards an extended position.

4. The system as recited in claim 3, further comprising a control arrangement for controlling the operation of the actuators.

5. The system as recited in claim 4, wherein the control arrangement includes a pluarity of solenoid actuated valves.

6. The system as recited in claim 5, wherein each solenoid actuated valve includes a bistable actuator.

7. The system as recited in claim 4, wherein the control arrangement includes a control unit, the motor is used to drive a drill bit, and the motor is located between the drill bit and at least part of the control unit.

8. The system as recited in claim 7, wherein the control unit includes at least one sensor arranged to sense a drilling parameter.

9. A system, comprising:

a steerable drilling system having:

a fluid powered motor disposed along a drillstring and rotatable with the drillstring, the fluid powered motor having a stator and a rotor;

a bias arrangement having at least three angularly spaced bias pads mounted in a housing rotatable with the stator, the at least three angularly spaced bias pads being selectively moveable by a pressure differential between drilling fluid upstream of the fluid powered motor and drilling fluid in a wellbore annulus outside of the fluid powered motor, the bias pads being selectively movable while the drillstring is rotating to steer the steerable drilling system so as to form a borehole of a desired curved form via application of side loads to the steerable drilling system, the pressure of drilling fluid upstream of the fluid powered motor being applied to the bias pads through an interior of the fluid powered motor via at least one interior passage extending past the rotor of the fluid powered motor; and a control unit to control extension of individual bias pads of the at least three angularly spaced bias pads as the at least three angularly spaced bias pads are rotated with the stator and the housing.

10. The system as recited in claim 9, wherein each bias pad is moveable by an actuator, and each actuator comprises a piston to which drilling fluid can be supplied to move the associated bias pad from a retracted position towards an extended position.

11. The system as recited in claim 10, further comprising an electromagnetic control arrangement for controlling the operation of the actuators.

12. The system as recited in claim 11, wherein the electromagnetic control arrangement includes a pluarity of solenoid actuated valves.

13. The system as recited in claim 12, wherein the electromagnetic control arrangement comprises a control unit and wherein the fluid powered motor is located between a drill bit and at least part of the control unit.

14. The system as recited in claim 11, wherein the electromagnetic control arrangement comprises at least one sensor arranged to sense a drilling parameter.

15. A system, comprising:

a steerable drilling system having:

a fluid powered motor; and a bias arrangement having at least three angularly spaced bias pads selectively moveable by a pressure differential between a higher pressure of drilling fluid upstream of the fluid powered motor and a lower pressure of drilling fluid in a wellbore annulus outside of the fluid powered motor, the bias pads being selectively exposed to the higher pressure via passages extending past the fluid powered motor, the bias pads being selectively movable while the steerable drilling system is rotated to steer the steerable drilling system so as to form a borehole of a desired curved form, the bias arrangement further comprising an electromagnetic control unit located upstream of the fluid powered motor, the electromagnetic control unit being configured to control actuation of the bias pads while the bias pads are rotated with the steerable drilling system.

16. The system as recited in claim 15, wherein each bias pad is moveable by an actuator, and each actuator comprises a piston to which drilling fluid can be supplied under the direction of the electromagnetic control unit to move the associated bias pad from a retracted position towards an extended position.

17. The system as recited in claim 15, wherein the electromagnetic control unit controls a pluarity of solenoid actuated valves.

18. The system as recited in claim 15, further comprising at least one sensor arranged to sense a drilling parameter.

19. A system, comprising:

a steerable drilling system having:

a fluid powered motor having a rotor disposed in a longitudinally extending passage through a stator; and a bias arrangement having three angularly spaced bias pads mounted for rotation with the stator, the three angularly spaced bias pads being moveable by a pressure differential between fluid upstream of the fluid powered motor and fluid in a wellbore annulus outside of the fluid powered motor, the bias arrangement further comprising a control unit located upstream of the fluid powered motor and a valve arrangement located upstream of the fluid powered motor, the control unit working in cooperation with the valve arrangement to selectively control flow of the fluid to individual bias pads of the three bias pads while the steerable drilling system and the three angularly spaced bias pads are rotated to selectively steer the steerable drilling system so as to form a borehole of a desired curved form, the three bias pads being selectively exposed to a higher pressure of the fluid upstream of the fluid powered motor via passages extending through the fluid powered motor and past the rotor separately from the longitudinally extending passage.

20. The system as recited in claim 19, wherein each bias pad is moveable by an actuator which comprises a piston.

21. The system as recited in claim 19 wherein the valve arrangement comprises a rotary valve.

22. The system as recited in claim 19, wherein the control unit comprises a sensor used to undertake measurements during use of the steerable drilling system in a drilling operation.

* * * * *